United States Patent [19]

Gary

[11] Patent Number: 4,830,322

[45] Date of Patent: May 16, 1989

[54] CHALKBOARD CHART HOLDER

[76] Inventor: Esther W. Gary, 5120 Stratford Chase Dr., Virginia Beach, Va. 23464

[21] Appl. No.: 140,693

[22] Filed: Jan. 4, 1988

[51] Int. Cl.[4] ..... A47B 63/02

[52] U.S. Cl. ..... 248/206.5; 211/45; 211/89; 248/316.5; 248/316.8

[58] Field of Search ..... 248/206.5, 316.5, 316.8, 248/547, 359 I, 359 A; 211/45, 89; 411/501

[56] References Cited

U.S. PATENT DOCUMENTS

| | | | |
|---|---|---|---|
| 60,351 | 12/1866 | Fisher | 211/89 X |
| 605,332 | 6/1898 | Owen . | |
| 2,400,058 | 5/1946 | Concannon | 211/89 X |
| 2,553,668 | 8/1948 | Morello | 33/207 |
| 2,580,193 | 12/1951 | Richterkessing | 211/89 X |
| 2,622,300 | 12/1952 | Marziani | 211/45 X |
| 2,977,082 | 3/1961 | Harris | 248/206.5 |
| 3,306,308 | 2/1967 | Shanok et al. | 248/206.5 X |
| 3,416,761 | 12/1968 | Shanok et al. | 248/206.5 X |
| 3,756,550 | 9/1973 | Kollitz | 248/206 |
| 4,108,413 | 8/1978 | Goserud | 248/316.8 X |
| 4,255,837 | 3/1981 | Holtz | 24/243 |

FOREIGN PATENT DOCUMENTS

| | | | |
|---|---|---|---|
| 81314 | 4/1956 | Netherlands | 211/89 |

*Primary Examiner*—Reinaldo P. Machado
*Assistant Examiner*—David L. Talbott
*Attorney, Agent, or Firm*—Griffin, Branigan & Butler

[57] ABSTRACT

A chalkboard chart holder (10) includes at least two spring-loaded, normally-closed, hand-openable, clamp assemblies (12) having permanent magnets (14) thereon mounted on an elongated support member (16). The chalkboard chart holder can be attached to a ferromagnetic chalkboard (68) by the magnets on the clamps so as to hold a chart (72) in the clamps on the chalkboard.

4 Claims, 1 Drawing Sheet

CHALKBOARD CHART HOLDER

BACKGROUND OF THE INVENTION

This invention relates broadly to the art of chart holders, and more specifically, to a particular chart holder which can be used for mounting charts on ferromagnetic chalkboards.

A constant need in classrooms and other lecture areas are devices for displaying placards, charts and the like. Often, chart display devices are mounted on tripods. Quite often, such tripods have clamps at the tops thereof to which charts, large paper tablets etc. are attached. Major difficulties with such chart display devices is that they use important classroom space and are difficult to store. Often, such display devices remain set up all the time even though they are only used now and then. Thus, it is an object of this invention to provide a chart display device which does not use important room space and which can be easily stored.

Sometimes large paper sheets are hung from nails, tacks or hooks in classrooms, however, difficulties with such arrangements are that the sheets cannot be easily moved from place to place (nail pairs must be positioned at each location) and individual sheets without rigid edges tend to tear on the nails. Further, if the sheets are moved from one set of nails to another set they tend to fold and must be straightened out when they are rehung. Similarly, tripod-type chart holders are also difficult to move from place to place, since they are rather bulky and heavy. Thus, it is an object of this invention to provide a chart holder which not only can be easily moved about but which can also be used to easily move single sheets from place to place, without tearing or wrinkling them. It is an object of this invention to provide a chart holder which when moved with single sheets therein provides a rigid spar at an edge of the sheets to keep them in an orderly manner.

It is a further object of this invention to provide a chart holder which is pleasing to look at but yet which is extremely effective in operation. Further, it is an object of this invention to provide a chart holder which can be used for combining charts with writings and drawings on a chalkboard so that these items can be placed in close proximity one to the other.

Yet another object of this invention is to provide a chart holder which can be mounted both on a chalkboard and hung from nails or hooks.

It is yet another object of this invention to provide a chart holder having the above qualities but yet being inexpensive to manufacture.

SUMMARY

According to principles of this invention, a chart holder comprises an elongated support member having two normally-closed, hand-openable, clamps mounted on a front side thereof and at least two permanent magnets mounted at a backside thereof. The magnets are used for mounting the chart holder on a ferromagnetic panel, such as a chalkboard, while the clamps, are arranged to selectively hold charts or sheets in a plane.

In the preferred embodiment, the magnets themselves are mounted on clamp assemblies, and the clamp assemblies are mounted on the elongated support member. Further, in a preferred embodiment the clamp assemblies have holes therein so that the chalkboard chart holder can also be mounted on nails or hooks.

BRIEF DESCRIPTION OF THE DRAWING

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
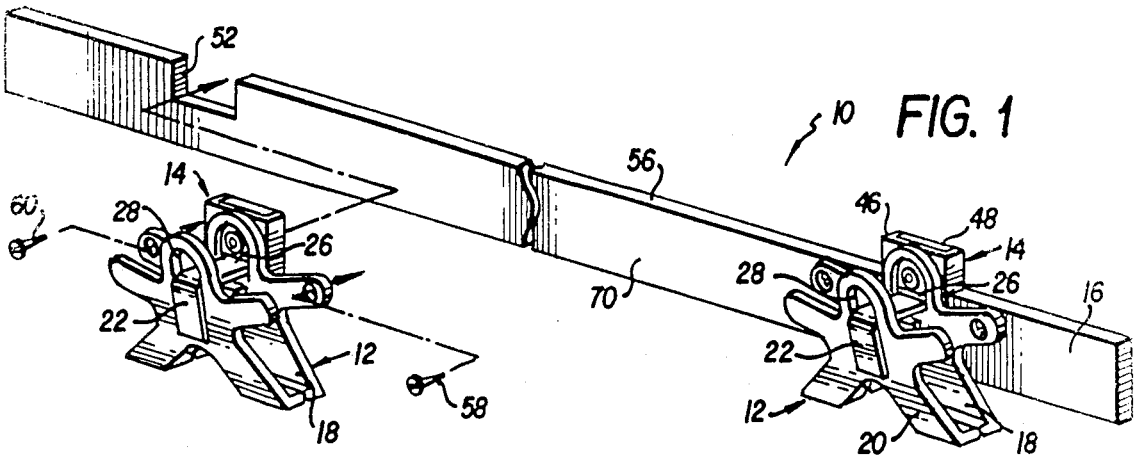
FIG. 1 is a front isometric, partially exploded, view of a chalkboard chart holder of this invention.
Figure 2:
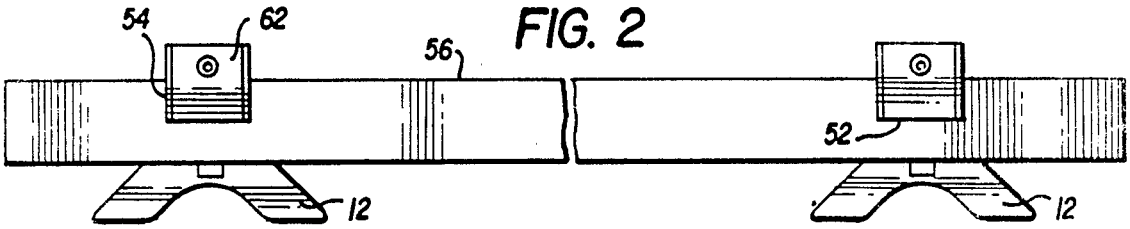
FIG. 2 is a rear view of the chalkboard chart holder of FIG. 1.

A chalkboard chart holder 10 comprises two spring-loaded, normally-closed, hand-openable, clamp assemblies 12, two permenant magnet assemblies 14 and an elongated support member 16.

Each of the clamp assemblies 12 comprises first and second clamping members 18 and 20, a spring 22, and first and second fulcrum members 23 and 24. The first and second clamping members 18 and 20 depicted in the drawings have humanized shapes, however, this is not important to the invention. All of the elements of the clamp assembly are constructed of plastic, however, it would be possible to construct some or all of these elements of metal, or other materials. Basically, the spring 22 has a horseshoe shape with opposite ends passing through openings 26 and 28 in the first and second clamping members 18 and 20, with the openings 26 and 28 being positioned above the first and second fulcrum members 23 and 24. End tips 30 and 32 of the spring 22, which have a tendency to close toward one another, are positioned below the first and second fulcrum members 23 and 24. Thus, the spring 22 tends to cause lower tips 34 and 36 of the first and second clamping members 18 and 20 to move toward one another gripping anything therebetween. With regard to the first and second fulcrum members 23 and 24, there is a pair of each of these protrusions positioned on opposite sides of the spring 22 but only one member of each pair can be seen in the drawings. Each member 23 of the first fulcrum-member pair has a rounded outer tip 38 and each member of the second fulcrum-member pair 24 has a cavity 40 for receiving the rounded outer tip 38 of the corresponding member of the first fulcrum pair. The rounded outer tip 38 and the rounded cavity 40 allow the fulcrum members to rotate relative to one another to thereby allow the clamping-member lower tips 34 and 36 to move toward and away from one another. Upper tips 42 and 44 thereof can be forced to move toward one another manually to open the lower tips 34 and 36.

Figure 3:
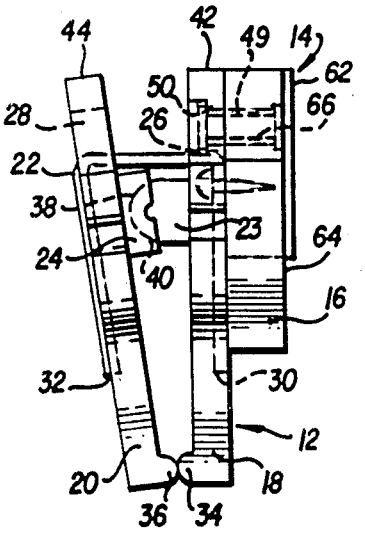
FIG. 3 is an end view of the chalkboard chart holder of FIG. 1.
Figure 4:
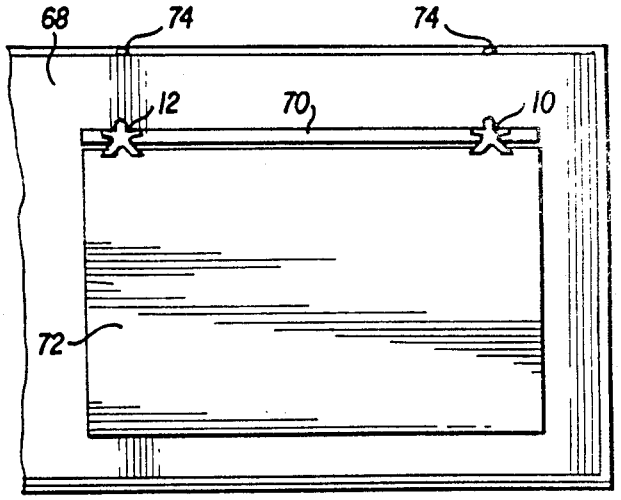
FIG. 4 is a front elevation view of the chalkboard chart holder of FIG. 1 mounted on a chalkboard and holding a chart in the clamps thereof.

The permanent magnet assemblies each comprises a U-shaped pole piece 46 and a permanent magnet 48 riveted thereto so as to be bedded between legs of the U-shaped pole piece 46. In the preferred embodiment, the same rivet 49 (FIG. 3) used to fasten the permanent magnet to the pole piece 48 also attaches to a web 50 molded as part of the first clamping member 18. In other words, the clamp assembly 12 and the permanent magnet assembly 14 are integrated into a single member by the rivet 49.

The elongated support 16 in one embodiment is constructed of wood, however it would be possible to construct this support of plastic or other materials, and is painted to have approximately the same color as the first and second clamping members 18 and 20, although this is not necessary for this invention. There are cutouts 52 and 54 substantially spaced from one another along the elongated support 16 at an upper edge 56 thereof. The cutouts 52 and 54 are of such a size to accommodate the pole pieces 46 of the permanent magnet assemblies 14.

The clamp assemblies 12 with their attached permanent magnet assemblies 14 are, in turn, fastened to the elongated support 14 by means of screws 58 and 60 which pass through the first clamping member 18 and are screwed directly into the elongated support 16, with the attached permanent magnet assemblies 14 thereof being positioned in the appropriate cutouts 52 and 54 so that fastening surfaces 62 of the permanent magnet assemblies 14 are positioned behind a back side 64 of the elongated support 16.

The rivet 49 has a bore 66 therethrough of a size for receiving a finishing nail.

In use, the chalkboard chart holder 10 is placed on a ferromagnetic chalkboard 68 with the fastening surfaces 62 of the permament magnet assemblies 14 being in contact with the ferromagnetic chalkboard 68. Attraction of the permanent magnet assemblies 14 to the chalkboard 68 hold the chalkboard chart holder 10 firmly thereon with the clamp assemblies 12 being positioned on a front surface 70 of the elongated support 16. A user depresses the upper tips 44 of the second clamping members 20 to cause the lower tips 34 and 36 to separate and places a chart 72, such as a sheet of paper, therebetween. When the second clamping members 20 are released, the lower tips 34 and 36 close on the chart 72 and thereby hold it on the ferromagentic chalkboard 68. The chalkboard chart holder 10 can also be used without a chalkboard by attaching it on metallic map holders that move back and forth on a track above many chalkboards and also by hanging it on finishing nails 74 that are nailed into a wall, frame or the like. Thus, the chart holder can be stored by hanging it on nails in this manner, and/or can be used for holding charts. Further, it will be appreciated by those of ordinary skill in the art that the chalkboard chart holder 10 can be moved around with an attached chart to any position on a ferromagnetic chalkboard 68. Further, The chart holder 10 is so small that it can be easily stored away in a closet, a drawer, or the like. With such a chart holder, charts can easily be placed beside writings on a chalkboard so that a teacher can key chalkboard writings to certain things appearing on charts. For example, if the chart 72 were a map, the teacher could draw arrows on the chalkboard 86 pointing to particular areas on the map which the teacher wishes to discuss.

One advantage of this invention is that it can be used to retain charts and move them about easily without folding them, having them become disorganized, or getting frayed or worn holes at the edges thereof. Further, the chalkboard chart holder of this invention is inexpensive to construct and can, therefore, be placed in common use inexpensively.

One particularly useful aspect of this invention is that two of the chart holders describe herein can be employed in tandem by placing one at the top of a chart and the other at the bottom. Both holders are then adhered to a chalkboard with the magnets thereof keeping the chart fully extended. This is especially helpful in displaying charts that have been rolled up.

Also, such a chart holder allows a teacher to easily use one part of a chalkboard for large-group instruction and another part for small group instruction.

Further, with such a chart holder the front of a chart could easily be used for main instructional material while the back is used for follow up instructional material. For example, questions could be on the front of a chart with an answer key therefor on the back. To see the answer key one need only pull the magnets off the chalkboard, which can easily be done while maintaining the chart in an orderly, fullyspread, configuration, and turning the chart around.

While the invention has been particularly shown and described with reference to a preferred embodiment, it will be understood by those skilled in the art that various changes in form and detail may be made therein without departing from the spirit and scope of the invention. For example, it is not necessary that the permanent magnet assemblies be riveted to the clamp assemblies but rather each of these members could be separately mounted on the elongated support 16. However, such a structure would be more labor intensive to construct than that described by applicant. Further, it is not necessary that the first and second clamping members 18 and 20 be shaped like little men. In this regard, many types of clamping assemblies could be used with this invention. A particular benefit of the invention as described by applicant is that the assembly is extremely stable even when one presses on the first clamping members 18 to open them. In this regard, charts can be easily placed in and removed from the chart holder of this invention without removing the chart holder from a chalkboard to which it is magnetically adhered.

The embodiments of the invention in which an exclusive property or privilege are claimed are defined as follows:

1. A chalkboard chart holder comprising:

at least two spring-loaded, normally-closed, hand-openable clamp assemblies, each of said clamp assemblies comprising first and second clamping members biased toward one another by spring means but including an actuation means which, when manually impinged on, moves said clamping members away from one another, to thereby form a normally-closed, but manually openable, clamp mouth for gripping sheet-like materials;

at least two permanent magnet assemblies having fastening surfaces; and an elongated support member, each of said clamp assemblies being attached to said elongated support member but being substantially spaced from one another along said elongated support member with said clamp mouths being positioned parallel with one another so that they can simultaneously hold a sheet in one plane and said permanent magnet assemblies being attached to said elongated support, but being substantially spaced from one another along said elongated support member with said attachment surfaces being in substantially the same attachment plane, said attachment plane not passing through said elongated support member or said clamp assemblies;

said permanent magnet assemblies being attached to top rear portions of said clamp assemblies and said rear surfaces of said clamp assemblies being adjacent to and attached to a front surface of said elongated support, the permanent magnet assemblies extending rearwardly from said clamp assemblies a distance grater then the thickness of said elongated support member so as to extend behind the support member with the fastening surfaces being behind the support member;

whereby said chalkboard chart holder can be placed on a ferromagnetic chalkboard with said fastening surfaces of said permanent magnet assemblies against said chalkboard and held there by magnetic attraction while a chart is held in said mouths of said clamp assemblies on said chalkboard.

2. A chalkboard chart holder as in claim 1, wherein said magnet assemblies have a hole therethrough through which nails can pass for allowing said chalkboard chart holder to be hung from two nails.

3. A chalkboard chart holder as in claim 2, wherein said holes are formed in rivets attaching said magnets to said clamp assemblies.

4. A chalkboard chart holder as in claim 1, wherein said elongated support is constructed of wood and said clamp assemblies are screwed to said elongated support.

* * * * *